US011602948B2

(12) United States Patent
Nigatu et al.

(10) Patent No.: US 11,602,948 B2
(45) Date of Patent: Mar. 14, 2023

(54) ARTICLES INCLUDING INFRARED ABSORPTIVE MATERIAL AND COMPRISING RADIATION-TREATED AND NON-RADIATION-TREATED REGIONS

(71) Applicant: 3M INNOVATIVE PROPERTIES COMPANY, St. Paul, MN (US)

(72) Inventors: Tadesse G. Nigatu, Cottage Grove, MN (US); Suman K. Patel, Woodbury, MN (US); Craig A. Schmidt, Lindstrom, MN (US); Lee A. Pavelka, Cottage Grove, MN (US); Neeraj Sharma, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 325 days.

(21) Appl. No.: 16/060,500

(22) PCT Filed: Dec. 6, 2016

(86) PCT No.: PCT/US2016/065199

§ 371 (c)(1),
(2) Date: Jun. 8, 2018

(87) PCT Pub. No.: WO2017/146799

PCT Pub. Date: Aug. 31, 2017

(65) Prior Publication Data

US 2018/0361776 A1 Dec. 20, 2018

Related U.S. Application Data

(60) Provisional application No. 62/264,756, filed on Dec. 8, 2015.

(51) Int. Cl.
*B42D 25/23* (2014.01)
*B42D 25/24* (2014.01)
(Continued)

(52) U.S. Cl.
CPC ..... *B42D 25/23* (2014.10); *B42D 25/24* (2014.10); *B42D 25/29* (2014.10); *B42D 25/324* (2014.10);
(Continued)

(58) Field of Classification Search
None
See application file for complete search history.

(56) References Cited

U.S. PATENT DOCUMENTS 6,243,201 B1 6/2001 Fleming
6,677,030 B2 1/2004 Thakkar
(Continued)

FOREIGN PATENT DOCUMENTS

WO WO 2011-038848 4/2011
WO WO 2011-129832 10/2011
(Continued)

OTHER PUBLICATIONS

International Search Report for PCT International Application No. PCT/US2016/065199, dated Oct. 11, 2017, 5 pages.

*Primary Examiner* — David R Dunn
*Assistant Examiner* — Christopher E Veraa

(57) ABSTRACT

Techniques are described in which articles (e.g., security documents, traffic signage and personal protective equipment) are formed to include an infrared absorptive material. In some instances, the infrared absorptive material includes a reduced tungsten oxide, such as cesium tungsten oxide, calcium tungsten oxide, potassium tungsten oxide, or the like, and exposed to radiation such that one or more regions of the security document has a modified appearance, thereby providing a visual marking or information on the article. Example articles include at least one layer including a polymer and an infrared absorptive material including a reduced tungsten oxide. The layer includes a radiation-
(Continued)

treated region that exhibits a first appearance under visible light and at least one non-radiation-treated region that exhibits a second, different appearance under visible light. The at least one radiation-treated region may be formed by exposing the at least one radiation-treated region to infrared light to change at least one property of the reduced tungsten oxide in the radiation-treated region compared to the reduced tungsten oxide in the non-radiation-treated region. The first appearance may be whiter than the second appearance.

13 Claims, 7 Drawing Sheets

(51) Int. Cl.

| | |
|---|---|
| ***B42D 25/29*** | (2014.01) |
| ***B42D 25/425*** | (2014.01) |
| ***B42D 25/382*** | (2014.01) |
| ***B42D 25/41*** | (2014.01) |
| ***B42D 25/324*** | (2014.01) |

(52) U.S. Cl.
CPC ..... *B42D 25/382* (2014.10); *B42D 25/41* (2014.10); *B42D 25/425* (2014.10)

(56) References Cited

U.S. PATENT DOCUMENTS

| | | | | |
|---|---|---|---|---|
| 7,422,334 | B2 | 9/2008 | Smith | |
| 2006/0178254 | A1 | 8/2006 | Takeda | |
| 2007/0087173 | A1 | 4/2007 | Endres | |
| 2010/0031290 | A1 | 2/2010 | Hua | |
| 2011/0065576 | A1* | 3/2011 | Campbell | B41M 5/267 503/215 |
| 2011/0272646 | A1 | 11/2011 | Meyer | |
| 2012/0200710 | A1 | 8/2012 | Nakajima | |
| 2012/0281285 | A1 | 11/2012 | Orensteen | |
| 2013/0034682 | A1 | 2/2013 | Free | |
| 2013/0320276 | A1 | 12/2013 | Farrell | |
| 2013/0323476 | A1* | 12/2013 | Farrell | B42D 25/29 428/195.1 |
| 2015/0191132 | A1 | 7/2015 | Muramoto | |
| 2016/0168407 | A1* | 6/2016 | Jarvis | G03G 7/00 424/443 |
| 2017/0120662 | A1* | 5/2017 | Kokkelenberg | B42D 25/00 |
| 2018/0264867 | A1* | 9/2018 | Jung | B41M 3/14 |

FOREIGN PATENT DOCUMENTS

| | | |
|---|---|---|
| WO | WO 2013-044000 | 3/2013 |
| WO | WO 2014-116431 | 7/2014 |

* cited by examiner

ARTICLES INCLUDING INFRARED ABSORPTIVE MATERIAL AND COMPRISING RADIATION-TREATED AND NON-RADIATION-TREATED REGIONS

CROSS REFERENCE TO RELATED APPLICATIONS

This application is a national stage filing under 35 U.S.C. 371 of PCT/US2016/065199, filed Dec. 6, 2016, which claims the benefit of Provisional Application No. 62/264,756, filed Dec. 8, 2015, the disclosures of which are incorporated by reference in their entirety herein.

TECHNICAL FIELD

The disclosure relates to articles including an infrared absorptive material and comprising radiation-treated and non-radiation-treated regions.

BACKGROUND

Information-conveying or indicia-containing articles are useful in a multitude of applications, such as, for example, in documents, traffic signs, license plates, validation stickers, personal protective equipment.

Documents of value or security documents such as passports, identification cards, entry passes, ownership certificates, financial instruments, and the like, are often assigned to a particular person by personalization data. Personalization data, often present as printed images, can include photographs, signatures, fingerprints, personal alphanumeric information, and barcodes, and allows human or electronic verification that the person presenting the document for inspection is the person to whom the document is assigned. There is widespread concern that forgery techniques can be used to alter the personalization data on such a document, thus allowing non-authorized people to pass the inspection step and use the document in a fraudulent manner.

A number of security features have been developed to help authenticate the document of value or security document, thus assisting in preventing counterfeiters from altering, duplicating or simulating a document of value. Some of these security features may include overt security features and covert security features. Overt security features are features that are easily viewable to the unaided eye, such features may include holograms and other diffractive optically variable images, embossed images, and color-shifting films. Covert security features include images only visible under certain conditions, such as inspection under light of a certain wavelength, polarized light, or retroreflected light.

In some instances, it is desired to increase readability of information or indicia in an article, such as in, for example, a traffic sign or a personal protective equipment. In some instances, detecting or reading information or indicia is carried out in wavelengths within the visible spectrum. In other instances, detecting or reading information or indicia is carried out in wavelengths outside the visible spectrum.

SUMMARY

In one aspect, the present inventors sought to develop articles including radiation-treated and non-radiation-treated regions. In some embodiments, the inventors sought to develop effective methods and materials to form indicia and/or information on an article.

In one aspect, this disclosure describes articles including infrared absorbing materials. In one embodiments, the infrared absorbing materials include a reduced tungsten oxide, such as cesium tungsten oxide, sodium tungsten oxide, potassium tungsten oxide, or the like. As described herein, one or more regions of the article or security document is treated with radiation, such as laser energy, to modify an appearance of the region under visible light, thereby providing a visual marking on the security document. As such, the techniques described herein provide CsWO-assisted marking of security documents or other articles.

In some examples, a security document includes at least one layer including a polymer and an infrared absorptive material, wherein the infrared absorptive material includes a reduced tungsten oxide. The at least one layer includes at least one radiation-treated region that exhibits a first appearance under exposure to visible light and at least one non-radiation-treated region that exhibits a second, different appearance under exposure to visible light. The first appearance may be whiter than the second, different appearance.

In some examples, a security document includes at least one layer including a polyurethane and an infrared absorptive material. The infrared absorptive material includes a reduced tungsten oxide. The at least one layer includes at least one radiation-treated region that exhibits a first appearance under exposure to visible light and at least one non-radiation-treated region that exhibits a second, different appearance under exposure to visible light. The radiation-treated region may be formed by exposing the at least one radiation-treated region to infrared coherent light (e.g., laser) to change at least one property of the reduced tungsten oxide in the at least one radiation-treated region compared to the at least one property of the reduced tungsten oxide in the at least one non-radiation-treated region.

In some examples, a method includes forming at least one layer comprising a polymer and an infrared absorptive material comprising a reduced tungsten oxide. The method also may include exposing at least one radiation-treated region of the at least one layer to coherent infrared light (e.g., laser) to change at least one property of the reduced tungsten oxide in the at least one radiation-treated region and cause the at least one radiation-treated region to exhibit a first appearance under exposure to visible light. At least one non-radiation-treated region of the at least one layer that has not been exposed to the infrared coherent light may exhibit a second, different appearance under exposure to visible light. The first appearance may be whiter than the second, different appearance.

The techniques described herein may provide certain advantages. For example, the techniques may be utilized to provide permanent marks on traffic signs, validation stickers, personal protective equipment and security documents, such as passports, national identification cards, driver license, license plates, or other articles.

The markings created as described herein may be more tamper resistant than markings formed by other techniques, as the markings are integral portions of a layer of the security document. Moreover, the reduced tungsten oxide-assisted marking techniques described herein may be used with a wide range of materials, such as acrylics, polyesters, polyurethanes, as well as polycarbonates, and may provide subtle or obvious markings depending upon the concentration of reduced tungsten oxide and the energy used to form the markings.

The techniques described herein may also be used to form indicia or information on articles. For example, the techniques may be used to form human-readable information on a license plate (e.g., plate identifier information) or on a traffic sign (e.g., "STOP", "YIELD", etc.).

The details of one or more examples are set forth in the accompanying drawings and the description below. Other features, objects, and advantages will be apparent from the description and drawings, and from the claims.

DETAILED DESCRIPTION

Figure 1:
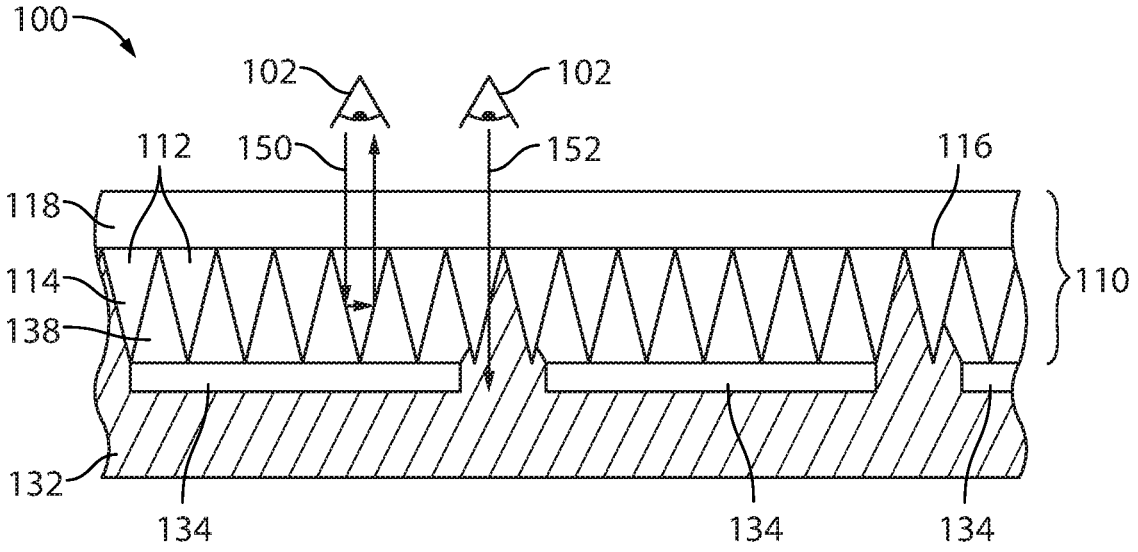
FIG. 1 is conceptual and schematic cross-sectional diagram of an example article including at least one layer including an infrared absorptive material including a reduced tungsten oxide.

The disclosure describes articles, security documents or documents of value that include at least one layer including an infrared absorptive material and at least one radiation-treated region and at least one non-radiation-treated region. In some embodiments, the infrared absorptive materials includes a reduced tungsten oxide. Infrared absorptive materials show selective absorption of infrared radiation (800 nm to 2,500 nm wavelengths) compared to visible radiation (400 nm to 800 nm wavelength). A reduced tungsten oxide is a mixed metal oxide that includes tungsten, and in which an average valence of tungsten is less than +6. Examples of reduced tungsten oxides include alkali tungsten oxides, such as cesium tungsten oxide ($Cs_{0.33}WO_3$, referred to as CsWO or CWO herein), sodium tungsten oxide, potassium tungsten oxide, and the like. In addition or as an alternative, the infrared absorptive material may include nanoparticles of doped metal oxides such as antimony tin oxide, indium tin oxide, mixed valent tungsten oxides, lanthanum hexaboride ($LaB_6$), IR absorbing dyes, IR absorbing pigments, and the like.

The reduced tungsten oxide may facilitate laser marking or laser engraving of the article or security document. The article may include a radiation-treated region that exhibits a first appearance under exposure to visible light and a non-radiation-treated region that exhibits a second, different appearance under exposure to visible light. The first and second appearances may be different, and the first appearance may be caused by exposing the reduced tungsten oxide in the at least one radiation-treated region to coherent electromagnetic radiation, such as coherent infrared (IR) light of a predetermined wavelength and energy. For example, exposing the radiation-treated region to IR laser may cause the first region to appear lighter (whiter) when exposed to visible length compared to the non-radiation-treated region.

In some examples, the article may include a structured layer, such as a layer including cube corner elements. Structured layers including cube corner elements may be difficult to mark using a laser, particularly in the absence of a vapor coating on the cube corner elements. Incorporating an infrared absorptive material into the structured layer may facilitate laser marking of the structured layer.

In other embodiments, the structured layer may comprise optical beads.

The amount of infrared-absorptive material, such as reduced tungsten oxide, in the layer (either structured layer or another layer) may affect the appearance change caused by the laser marking. For example, the reduced tungsten oxide may cause the layer to exhibit a tint in visible light. CsWO may cause the layer to exhibit a blue tint in visible light. In general, a greater amount of reduced tungsten oxide in the layer may cause a greater tint. As the tint is greater, the difference in visible appearance between the radiation-treated region and the non-radiation-treated region may be greater.

In some examples, rather than including relatively higher amounts of the reduced tungsten oxide, the layer may include a relatively low amount of the reduced tungsten oxide, such that the tint in visible light caused by the reduced tungsten oxide is reduced. In some of these examples, the difference in visible appearance between the radiation-treated region and the non-radiation-treated region may be relatively small, resulting in a relatively subtle or covert mark in visible light.

In addition to changing appearance in visible light, exposing the radiation-treated region to the coherent electromagnetic radiation (laser) of a predetermined wavelength and energy may affect the appearance of the radiation-treated region under exposure to IR light, under retroreflective light, or both. For example, the radiation-treated region under exposure to IR light may appear lighter than the non-radiation-treated region under exposure to IR light, as the IR absorption properties of the infrared absorptive material may be changed by the exposure to the coherent electromagnetic radiation of a predetermined wavelength and energy. In some instances, the laser may alter one of the composition or structure of the infrared absorptive material. In some embodiments, the radiation-treated regions no longer absorb radiation in the infrared spectrum and may appear dark when exposed to IR light. As another example, in instances in which the infrared-absorptive material is included in cube corner elements, the radiation-treated region under exposure to retroreflective light (e.g., ambient or infrared) may appear darker than the radiation-treated region, as the retroreflectivity of the cube corner elements may be changed by the exposure to the coherent electromagnetic radiation of a predetermined wavelength and energy. In one or more of these ways, the layer including the reduced tungsten oxide may be marked using a laser, and the marks may, in some examples, be relatively subtle in visible light and more obvious in ambient visible or IR light, retroreflective visible or IR light, or both.

In some examples, the energy of the coherent electromagnetic radiation to which the infrared absorptive material in the radiation-treated region is exposed may affect the appearance of the radiation-treated region. For example, relatively lower energy may result in less lightening, while relatively higher energy may result in more lightening. In some examples, if the energy is even higher, charring may result, and the appearance may be darker (e.g., brown or gray or black). In this way, coherent electromagnetic radiation may be used to change appearance of regions including an infrared absorptive material including a reduced tungsten oxide, and the appearance may include one or more of a variety of colors, including lighter (e.g., whiter) colors and darker (e.g., black or brown) colors. The radiation-treated region or multiple radiation-treated regions may be formed in a predetermined pattern, e.g., to represent one or more graphemes (e.g., any alphabetic, logographic or syllabic characters), an image, a barcode, another symbol, or the like and combinations thereof. Because the infrared absorptive material is part of the at least one layer, the predetermined pattern may be difficult to alter or destroy without altering or destroying the at least one layer, and thus may assisting in preventing counterfeiters from altering, duplicating or simulating an article or document of value.

FIG. 1 is a conceptual and schematic cross-sectional diagram of an example article 100 including at least one layer including an infrared absorptive material including a reduced tungsten oxide, such as CsWO, calcium tungsten oxide, potassium tungsten oxide, or the like. Article 100 includes a microreplicated structured layer 110, a conforming layer 132, and at least one barrier element 134 between microreplicated structured layer 110 and conforming layer 132. At least one of microreplicated structured layer 110, conforming layer 132, or at least one barrier element 134 may include an infrared absorptive material including CsWO.

Microreplicated structured layer 110 may include any type of microstructured surface, including, for example, beads, lenslets, prisms, or cube corner elements. In the example of FIG. 1, microreplicated structured layer 110 includes multiple cube corner elements 112 that collectively form a structured surface 114 opposite a major surface 116. Cube corner elements 112 may be full cubes, truncated cubes, or preferred geometry (PG) cubes as described in, for example, U.S. Pat. No. 7,422,334, which is incorporated herein by reference in its entirety. In some examples, cube corner elements 112 may be canted with respect to each other such that retroreflectivity is improved over a wider range of incident light angles.

Cube corner elements 112 include a polymeric material, such as, for example, a polycarbonate, a polyacrylate, an acrylic, a polyurethane, a polyester, or the like. Some more specific examples of polymers for cube corner elements 104 include poly(carbonate), poly(methylmethacrylate), poly (ethyleneterephthalate), aliphatic polyurethanes, as well as ethylene copolymers and ionomers thereof. Some example radiation-curable polymers for use in cube corner elements 104 include cross linked acrylates, such as multifunctional acrylates or epoxies and acrylated urethanes blended with mono- and multifunctional monomers.

Microreplicated structured layer 110 shown in FIG. 1 also includes a body layer 118. In alternate embodiments, in addition to or in lieu of the body layer, the cube corner elements 112 may include a land layer or land portion. The term "land layer" as used in the present application refers to a continuous layer of material coextensive with the cube corner elements and composed of the same material.

In the example of FIG. 1, article 100 also includes a conforming layer 132, which is located below microreplicated structured layer 110 from the perspective of viewer 102. In some examples, conforming layer 132 includes an adhesive. Exemplary adhesives that may be used in conforming layer 132 may include those described in PCT Patent Application No. PCT/US2010/031290, which is incorporated herein by reference in its entirety. In examples in which conforming layer 132 includes an adhesive, conforming layer 132 may assist in holding article 100 together.

In some examples, conforming layer 132 includes a pressure sensitive adhesive. The PSTC (Pressure Sensitive Tape Council) definition of a pressure sensitive adhesive is an adhesive that is permanently tacky at room temperature and which adheres to a variety of surfaces with light pressure (finger pressure) with no phase change (liquid to solid). While most adhesives (e.g., hot melt adhesives) require both heat and pressure to conform, pressure sensitive adhesives typically only require pressure to conform. Exemplary pressure sensitive adhesives include those described in U.S. Pat. No. 6,677,030, which is incorporated herein by reference in its entirety.

Article 100 also may include at least one barrier element 134 positioned between microreplicated structured layer 110 and conforming layer 132. At least one barrier element 134 form a physical "barrier" between cube corner elements 112 and conforming layer 132 and define low refractive index area 138. At least one barrier element 134 can directly contact, be spaced apart from, or push slightly into the tips of cube corner elements 112. At least one barrier element 134 also may prevent conforming layer 132 from wetting out cube corner elements 112.

At least one barrier element 134 may include any material that prevents the material of conforming layer 132 from contacting cube corner elements 112 or flowing or creeping into low refractive index area 138. Example materials for use in at least one barrier element 134 include polymeric materials, including resins, vinyls, UV-curable polymers, or the like. The size and spacing of the at least one barrier element 134 may be varied. In some examples, at least one barrier element 134 may form a pattern in article 100. In some examples, the patterns may be continuous, discontinuous, monotonic, dotted, serpentine, any smoothly varying function, stripes, or the like.

Cube corner elements 112 and at least one barrier element 134 define low refractive index area 138 between cube corner elements 112 and at least one barrier element 134. The low refractive index area 138 enables total internal reflection such that light that is incident on cube corner elements 112 adjacent to low refractive index area 138 is retroreflected. As shown in FIG. 1, a light ray 150 incident on a cube corner element 112 that is adjacent to low refractive index layer 138 is retroreflected back to viewer 102. For this reason, an area of article 100 that includes low refractive index layer 138 may be referred to as an optically active area. In contrast, an area of article 100 that does not include low refractive index area 138 can be referred to as an optically inactive area because it does not substantially retroreflect incident light, as shown by light ray 152. As used herein, the term "optically inactive area" refers to an area that is at least 50% less optically active (e.g., retroreflective) than an optically active area. In some embodiments, the optically inactive area is at least 40% less optically active, or at least 30% less optically active, or at least 20% less optically active, or at least 10% less optically active, or at least at least 5% less optically active than an optically active area.

Low refractive index layer 138 includes a material that has a refractive index that is less than about 1.30, less than about 1.25, less than about 1.2, less than about 1.15, less than about 1.10, or less than about 1.05. In some examples, low refractive index area 138 may include, for example, a gas (e.g., air, nitrogen, argon, and the like). In other examples, low refractive index area includes a solid or liquid substance that can flow into voids between or be pressed onto cube corner elements 112. Example materials include, for example, ultra-low index coatings (such as those described in PCT Patent Application No. PCT/US2010/031290), gels, or the like.

In accordance with one or more examples of this disclosure, at least one layer of article 100, such as at least one of microreplicated structured layer 110 (including cube corner elements 112, body layer 118, or both), conforming layer 132, or at least one barrier element 134, may include an infrared (IR) absorptive material. In some embodiments, the infrared absorptive material includes a reduced tungsten oxide. The reduced tungsten oxide may include, for example, microparticles or nanoparticles that absorb at least some IR light incident on the at least one layer that includes the IR absorptive material including the reduced tungsten oxide. When the infrared absorptive materials is disposed in the optical path of light (e.g., in a layer disposed between a light source and the cube corner elements 112, or in the cube corner elements 112) the article may exhibit reduced brightness when exposed to IR light of the wavelength(s) at least partially absorbed by the IR absorptive material.

When the IR absorptive material includes the reduced tungsten oxide, it may change the appearance of article 100 under exposure to visible light. For example, CsWO nanoparticles may have high transparency in most of the visible spectrum but a moderate absorption in the red part of the spectrum. Hence, CsWO may cause the at least one layer that includes the IR absorptive material including CsWO to have a blue tint under exposure to visible light e.g., compared to an example in which the at least one layer does not include the IR absorptive material including CsWO. Other reduced tungsten oxides may cause similar tints (of the same or a different color) under exposure to visible light. Further, a greater concentration of the reduced tungsten oxide in the at least one layer may result in a stronger blue tint. In some examples, the at least one layer may include greater than 0 weight percent (wt. %) and less than about 5 wt. % of the IR absorptive material including the reduced tungsten oxide. In other examples, the at least one layer may include between about 0.125 wt. % and about 5 wt. % of the IR absorptive material including the reduced tungsten oxide, or between about 0.125 wt. % and about 3 wt. % of the IR absorptive material including the reduced tungsten oxide, or between about 0.125 wt. % and about 1 wt. % of the IR absorptive material including the reduced tungsten oxide, or between about 2 wt. % and about 3 wt. % of the IR absorptive material including the reduced tungsten oxide.

However, by exposing at least one radiation-treated region of the at least one layer that includes the IR absorptive material including the reduced tungsten oxide to coherent electromagnetic radiation, such as infrared (IR) light, having a predetermined wavelength and power, the appearance of the at least one radiation-treated region may be changed. For example, the at least one radiation-treated region may exhibit a lighter (e.g., whiter) appearance under exposure to visible light after being exposed to coherent electromagnetic radiation having a predetermined wavelength and energy compared to at least one non-radiation-treated region that includes the reduced tungsten oxide and has not been exposed to the coherent electromagnetic radiation having a predetermined wavelength and energy.

In some examples, the energy of the coherent electromagnetic radiation to which the reduced tungsten oxide in the at least one radiation-treated region is exposed may affect the first appearance. For example, relatively lower energy may result in relatively less lightening, while relatively higher energy may result in relatively more lightening. In some examples, if the energy is even higher, charring may result, and the appearance may be darker (e.g., brown or gray or black).

The degree to which the at least one radiation-treated region changes appearance (e.g., lightens or darkens) may additionally be based on an amount of the infrared absorptive material including the reduced tungsten oxide in the at least one. For example, in examples in which the at least one layer includes a relatively higher percentage of the reduced tungsten oxide, the at least one layer may exhibit a greater tint under exposure to visible light, so the difference in lightening upon exposure to the coherent electromagnetic radiation having a predetermined wavelength and energy may appear greater, while the difference in darkening upon exposure to the coherent electromagnetic radiation having a predetermined wavelength and (higher) energy may appear less. In this way, if the at least one layer includes a relatively lower amount of the reduced tungsten oxide (e.g., less than 1 wt. % or less than 0.5 wt. % of the reduced tungsten oxide), exposure to the coherent electromagnetic radiation may form a mark that is relatively subtle or covert under visible light.

In some examples, the predetermined wavelength may include about 1064 nm (infrared light). For example, a neodymium-yttrium vanadate ($Nd:YVO_4$) laser may be used as the source of laser light having a wavelength of about 1064 nm.

In some examples, in addition to affecting the appearance of the at least one radiation-treated region under visible light, exposure to the coherent electromagnetic radiation having a predetermined wavelength and energy may change an appearance of the at least one radiation-treated region under exposure to IR light. For example, the at least one radiation-treated region may absorb less IR light than the at least on non-radiation-treated region, and thus also may appear lighter or brighter than the at least one non-radiation-treated region under exposure to IR light.

Additionally or alternatively, in some examples, cube corner elements 112 may include the at least one infrared absorber including CsWO. In some such examples, the at least one radiation-treated region may have a different retroreflectivity than the at least one non-radiation-treated region after being exposed to the coherent electromagnetic radiation having a predetermined wavelength and energy. For example, the at least one radiation-treated region may have a lower retroreflectivity than the at least one non-radiation-treated region and thus appear darker under exposure to retroreflective light, where the retroreflectivity is defined as a percentage of incident light retroreflected by the respective regions of cube corner elements. In some examples, the at least one radiation-treated region may be substantially non-retroreflective.

In this way, coherent electromagnetic radiation may be used to change appearance of the at least one radiation-treated region including an infrared absorptive material including the reduced tungsten oxide, and the appearance change may include at least one of appearance under exposure to visible light, appearance under exposure to IR light, or retroreflectivity. The appearance under exposure to visible light may include one or more of a variety of colors, including lighter (e.g., whiter) colors and darker (e.g., black or brown) colors. The radiation-treated region or multiple radiation-treated regions may be formed in a predetermined pattern of appearance, e.g., to represent one or more alphanumeric characters, an image, a barcode, another symbol, or the like. Further, because the appearance may be under exposure to visible light, under exposure to IR light, or under retroreflectivity, the change in appearance may be overt, covert, or both. Similarly, because the change in appearance may be a lightening or whitening under exposure to visible or IR light, the first appearance may be relatively subtly different than the second, different appearance. Because the infrared absorptive material including CsWO is part of the at least one layer, the predetermined pattern may be difficult to alter or destroy without altering or destroying the at least one layer, and thus may assisting in preventing counterfeiters from altering, duplicating or simulating article 100.

In some embodiments, article 100 is one of a security document (e.g., a passport, an identification document, a bank note or a license plate), transportation signage (e.g., traffic sign, street sign, barrels or cones), validation stickers, and personal protective equipment (e.g., garments).

Figure 2:
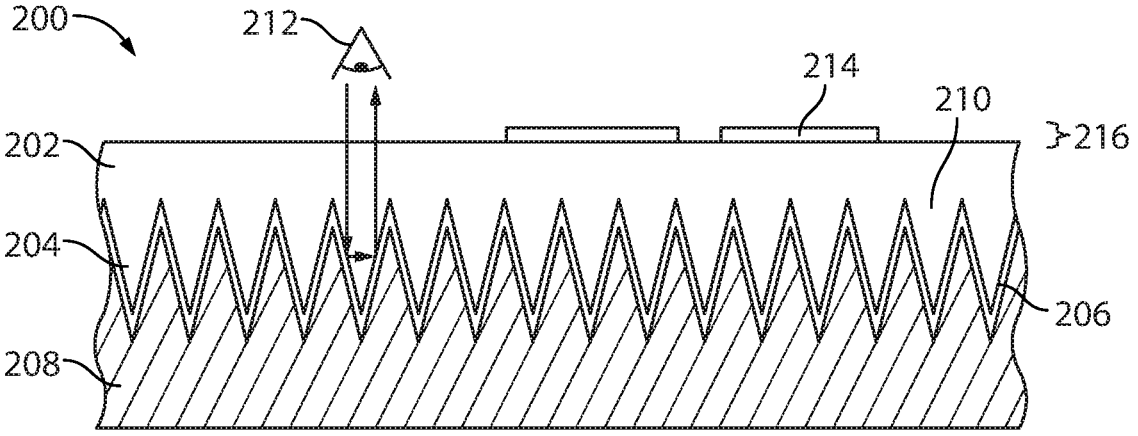
FIG. 2 is conceptual and schematic cross-sectional diagram of an example security document including at least one layer including an infrared absorptive material including a reduced tungsten oxide.

FIG. 2 is conceptual and schematic cross-sectional diagram of an example security document 200 that includes at least one layer including an infrared absorptive material including CsWO. Unlike article 100 of FIG. 1, security document 200 does not include at least one barrier element 134. Rather, security document 200 includes a structured layer 202 including a plurality of cube corner elements 204, a reflector layer 206 on the backside of cube corner elements 204, and a conforming layer 206 on the backside of cube corner elements 204.

Structured layer 202 including plurality of cube corner elements 204 may be similar to or substantially the same as microreplicated structured layer 110 and cube corner elements 112 illustrated in and described with respect to FIG. 1. Similarly, conforming layer 208 may be similar to or substantially the same as conforming layer 132 illustrated in and described with respect to FIG. 1.

Reflector layer 206 has good adhesion to cube corner elements 204 and reflects at least some wavelengths of light, including, for example, at least one of visible light or IR light. Reflector layer 206 can be formed, for example, using metal vapor deposition. Aluminum, silver, or the like may be used as the metal. Use of a suitable primer material such as a titanium metal sputter coated on cube corner elements 204 has been found to enhance the adhesion of the vapor deposition. Use of a metallic layer, may increase the entrance angularity of cube corner elements 204. Alternatively, reflector layer 206 may include a multilayer reflective coating disposed on the cube corner elements 204, such as is described, for example, in U.S. Pat. No. 6,243,201 to Fleming. The thickness of reflector layer 206 may be between about 300 Angstroms and about 800 Angstroms.

In some examples, security document 200 also includes at least one indicia 214, which may be part of a information-containing layer 216. At least one indicia 214 may be readable from the vantage point of a viewer 212. At least one indicia 214 may include an alphanumeric character such as a letter or a number, a symbol, or the like.

In some examples, at least one indicia 214 is embossed on the surface of structured layer 202, e.g., using roll coating. In other examples, at least one indicia 214 may be printed on the surface of structured layer 402, e.g., using ink jet printing, laser printing, or the like. At least one indicia 214 may be a different color than the remainder of security document 200 when viewed from the vantage point of viewer 212. For example, at least one indicia 214 may possess a darker color (e.g., black) than the remainder of security document 200 when viewed from the vantage point of viewer 212. In some examples, at least one indicia 214 may represent the alphanumeric content of security document 200 (e.g., holder's name, issuing jurisdiction, issue date or expiration date, or the like), an image, or the like.

In some examples, security document 200 may include at least one layer including an IR absorptive material including a reduced tungsten oxide, such as CsWO, calcium tungsten oxide, potassium tungsten oxide, or the like. For example, structured layer 202 may include the at least one layer including an IR absorptive material including the reduced tungsten oxide. The structured layer 202 may include at least one radiation-treated region and at least one non-radiation-treated region. The at least one radiation-treated region may exhibit an appearance under visible light that is lighter (e.g., whiter) than the appearance of the at least one non-radiation-treated region.

In some examples, the at least one radiation-treated region is positioned within structured layer 202 so that the at least one radiation-treated region is adjacent to an edge of the at least one indicia 214. For example, the at least one radiation-treated region may substantially trace the respective edges of the at least one indicia 214. In other examples, the at least one radiation-treated region may be disposed in a different relationship to the at least one indicia 214. For example, the at least one radiation-treated region may define respective curvilinear or polygonal shapes around respective ones of the at least one indicia 214.

Figure 3:
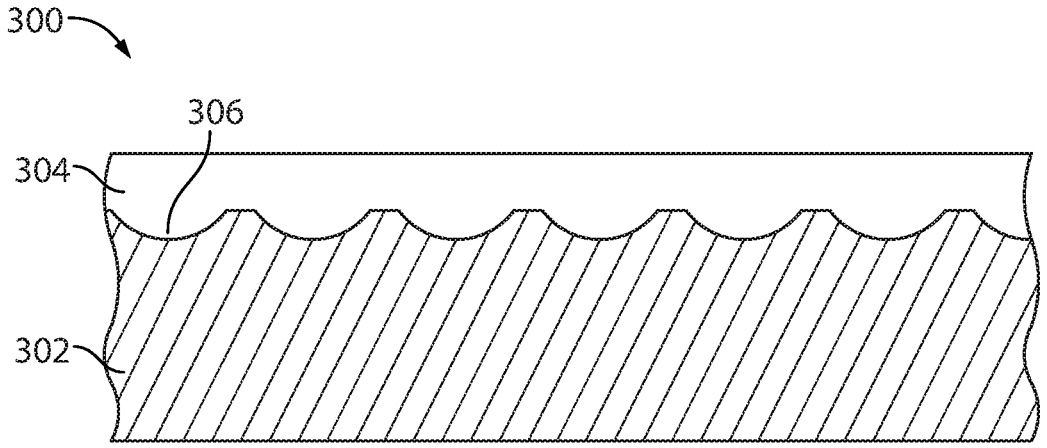
FIG. 3 is conceptual and schematic cross-sectional diagram of another example security document including at least one layer including an infrared absorptive material including a reduced tungsten oxide.

In some examples, rather than including a microreplicated structured layer or surface including cube corner elements or prisms, a security document may include a microreplicated surface including lenses. FIG. 3 is conceptual and schematic cross-sectional diagram of another example security document 300 including at least one layer including an infrared absorptive material including cesium tungsten oxide. Unlike article 100 of FIG. 1 and security document 200 of FIG. 2, security document 300 of FIG. 300 includes a microreplicated structured layer 304 including a plurality of microlenses 306, and also includes a conforming layer 302. In some examples, at least one of microreplicated structured layer 304 or conforming layer 302 may include a polymer and at least one IR absorptive material including a reduced tungsten oxide.

In examples in which microreplicated structured layer 304 includes the polymer and the at least one IR absorptive material including the reduced tungsten oxide, the polymer may include a polycarbonate, a polyacrylate, and acrylic, a polyurethane, a polyester, or the like. Some more specific examples of polymers for cube corner elements 104 include poly(carbonate), poly(methylmethacrylate), poly(ethylene-terephthalate), aliphatic polyurethanes, as well as ethylene copolymers and ionomers thereof. Some example radiation-curable polymers for use in cube corner elements 104 include cross linked acrylates, such as multifunctional acrylates or epoxies and acrylated urethanes blended with mono- and multifunctional monomers. In examples in which conforming layer 302 includes the polymer and the at least one IR absorptive material including the reduced tungsten oxide, the polymer may include an adhesive, such as a pressure sensitive adhesive.

Figure 4:
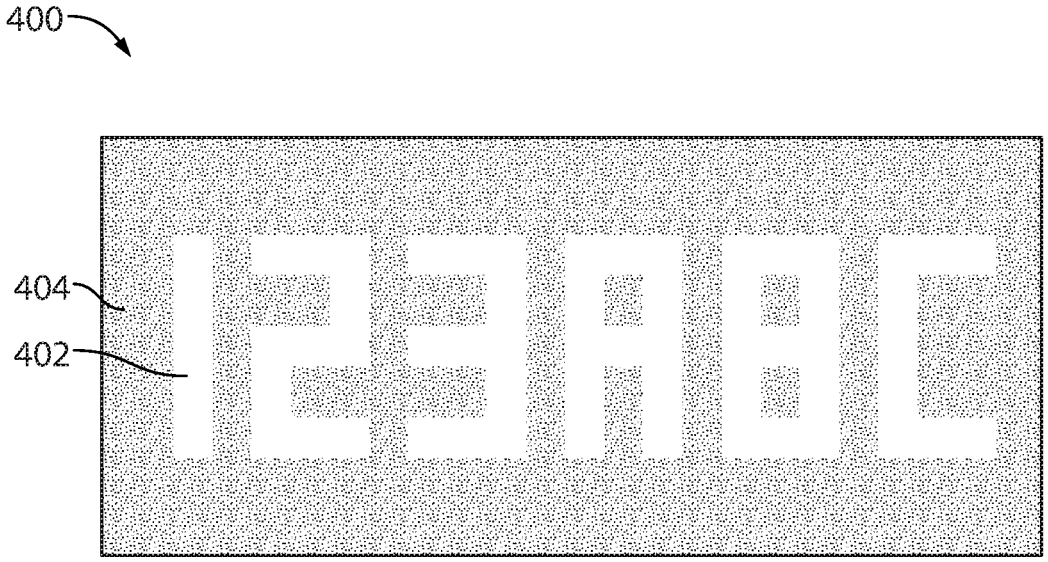
FIG. 4 is conceptual and schematic top view of another example including at least one layer including an infrared absorptive material including a reduced tungsten oxide.

FIG. 4 is a conceptual and schematic top view of an example security document 400 that includes an IR absorptive material including a reduced tungsten oxide. Security document 400 of FIG. 4 may include, for example, any of the constructions described above with respect to FIGS. 1-3.

As shown in FIG. 4, security document 400 includes at least one radiation-treated region 402 and at least one non-radiation-treated region 404. At least one radiation-treated region 402 may exhibit a first appearance under exposure to visible light, and at least one non-radiation-treated region 404 may exhibit a second, different appearance under exposure to visible light. For example, as shown in FIG. 4, at least one radiation-treated region 402 may exhibit a lighter (e.g., whiter) appearance under exposure to visible light after being exposed to coherent electromagnetic radiation having a predetermined wavelength and energy compared to at least one non-radiation-treated region 404 that includes the reduced tungsten oxide and has not been exposed to the coherent electromagnetic radiation having a predetermined wavelength and energy. In some examples, the energy of the IR light to which the reduced tungsten oxide in at least one radiation-treated region 402 is exposed may affect the first appearance. For example, relatively lower energy may result in relatively less lightening, while relatively higher energy may result in relatively more lightening. In some examples, if the energy is even higher, charring may result, and the appearance may be darker (e.g., brown or gray or black).

The degree to which the at least one radiation-treated region 402 changes appearance (e.g., lightens or darkens) may additionally be based on an amount of the infrared absorptive material including the reduced tungsten oxide in the at least one layer or the like. For example, in examples in which the at least one layer includes a relatively higher percentage of CsWO, the at least one layer may exhibit a greater blue tint under exposure to visible light, so the difference in lightening upon exposure to the coherent electromagnetic radiation having a predetermined wavelength and energy may appear greater, while the difference in darkening upon exposure to the coherent electromagnetic radiation having a predetermined wavelength and (higher) energy may appear less.

In some examples, in addition to affecting the appearance of at least one radiation-treated region 402 under visible light, exposure to the coherent electromagnetic radiation having a predetermined wavelength and energy may change an appearance of at least one radiation-treated region 402 under exposure to IR light. For example, at least one radiation-treated region 402 may absorb less IR light than at least one non-radiation-treated region 404, and thus also may appear lighter or brighter than at least one non-radiation-treated region 404 under exposure to IR light.

In this way, coherent electromagnetic radiation may be used to change appearance of at least one radiation-treated region 402 including an infrared absorptive material including the reduced tungsten oxide, and the appearance change may include at least one of appearance under exposure to visible light, appearance under exposure to IR light, or retroreflectivity (in examples in which the at least one layer including an IR absorptive material including the reduced tungsten oxide includes a layer including retroreflective structures, such as cube corner elements). In contrast to other IR infrared absorptive materials, the reduced tungsten oxide may allow a greater variety of appearances to be formed, including lighter appearances under visible light. The appearance under exposure to visible light may include one or more of a variety of colors, including lighter (e.g., whiter) colors and darker (e.g., black or brown) colors. The radiation-treated region or multiple radiation-treated regions may be formed in a predetermined pattern of appearance, e.g., to represent one or more alphanumeric characters, an image, a barcode, another symbol, or the like. Further, because the appearance may be under exposure to visible light, under exposure to IR light, or under retroreflectivity, the change in appearance may be overt, covert, or both. Similarly, because the change in appearance may be a lightening or whitening under exposure to visible or IR light, the first appearance may be relatively subtly different than the second, different appearance. Because the infrared absorptive material including the reduced tungsten oxide is part of the at least one layer, the predetermined pattern may be difficult to alter or destroy without altering or destroying the at least one layer, and thus may assisting in preventing counterfeiters from altering, duplicating or simulating security document 400.

Figure 5:
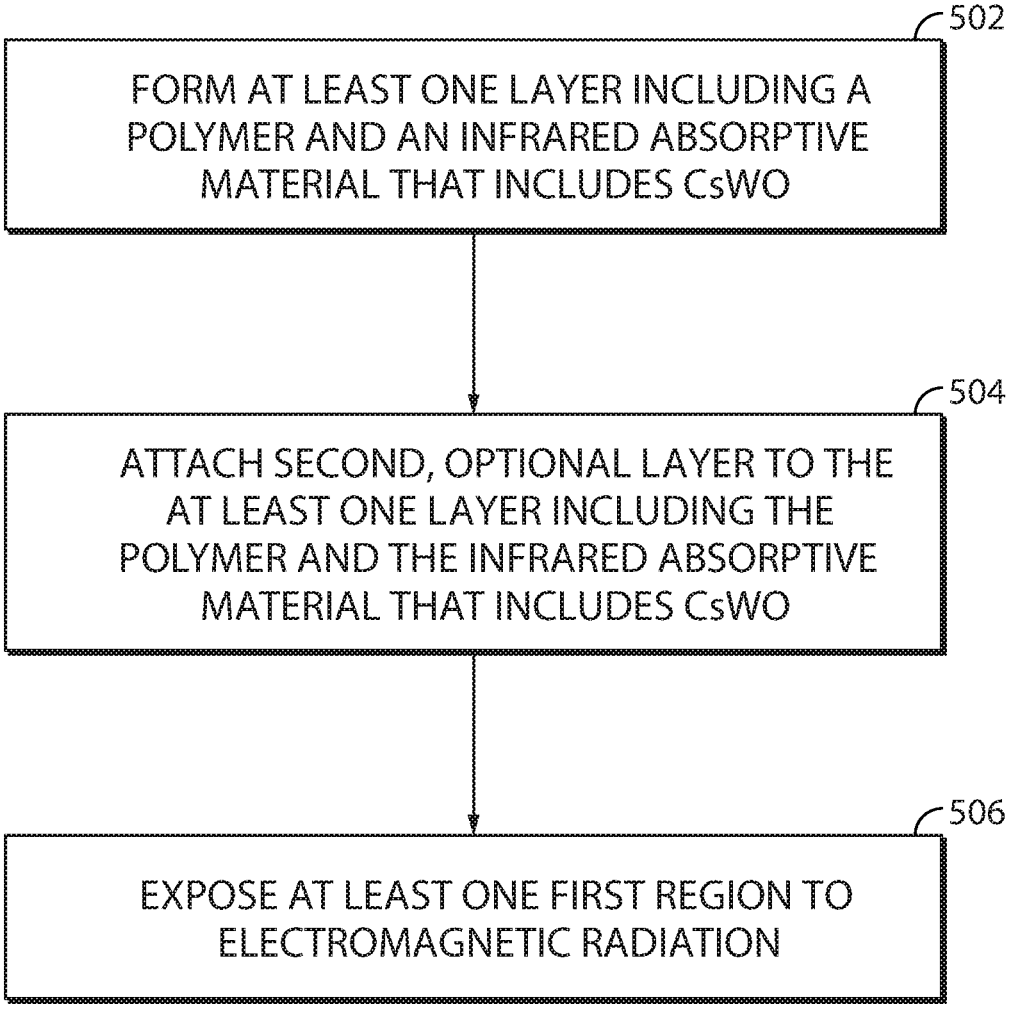
FIG. 5 is a flow diagram illustrating an example technique for forming a security document including at least one layer including an infrared absorptive material including a reduced tungsten oxide.

The security documents described herein may formed using one or more of a variety of techniques. For example, FIG. 5 is a flow diagram illustrating an example technique for forming a security document including at least one layer including an IR absorptive material including CsWO. The technique of FIG. 5 will be described with respect to article 100 of FIG. 1 for purposes of illustration only. In other examples, article 100 may be formed using a different technique than the technique of FIG. 5, and the technique of FIG. 5 may be used to form other security documents, such as security document 200 of FIG. 2, security document 300 of FIG. 3, or security document 400 of FIG. 4.

The technique of FIG. 5 includes forming at least one layer including a polymer and an IR absorptive material that includes the reduced tungsten oxide (502). The at least one layer may include, for example, microreplicated structured layer 110, at least one barrier element 134, or conforming layer 132. In some examples, such as when the polymer includes a radiation-curable polymer, the technique may include curing a mixture including the radiation-curable polymer precursor and the reduced tungsten oxide to form the at least one layer, e.g., microreplicated structured layer 110 that includes the plurality of cube corner elements 112 including the radiation-curable polymer and the reduced tungsten oxide.

In some examples, the IR absorptive material that includes the reduced tungsten oxide may be mixed directly with the polymer. In other examples, the IR absorptive material that includes the reduced tungsten oxide may first be mixed with a water compatible monomer system, then may be mixed with a water-based dispersion that may be cast and dried or cured to form the at least one layer. In this way, the IR absorptive material that includes the reduced tungsten oxide may be incorporated into layers formed using water-based dispersions of polymers, monomers, or both. This may facilitate use of the IR absorptive material that includes the reduced tungsten oxide in a greater number of polymer layers than some other IR absorptive materials.

In some examples, the technique of FIG. 5 may optionally include attaching a second, optional layer to the at least one layer including the polymer and the IR absorptive material that includes the reduced tungsten oxide (504). The second, optional layer may include any of the layers described herein, depending on which layer includes the IR absorptive material that includes the reduced tungsten oxide. For example, if microreplicated structured layer 110 includes the IR absorptive material that includes the reduced tungsten oxide, the second, optional layer may include conforming layer 132, at least one barrier element 134, reflector layer 206 (FIG. 2), conforming layer 208 (FIG. 2), at least one indicia 214 (FIG. 2), or the like. The technique used to attach the second, optional layer may vary depending on the type of second, optional layer. For example, at least one indicia 214 (FIG. 2) may be attached to the at least one layer using a printing technique, while reflector layer 206 (FIG. 2) may be attached to the at least one layer using a vapor deposition technique.

The technique of FIG. 5 further includes exposing at least one radiation-treated region to coherent electromagnetic radiation (e.g., infrared light) to change at least one property of the reduced tungsten oxide in the at least one radiation-treated region and cause the at least one radiation-treated region to exhibit a first appearance under exposure to visible light (506). The at least one non-radiation-treated region that has not been exposed to the coherent electromagnetic radiation (e.g., infrared light) may exhibit a second, different appearance under exposure to visible light. Additionally, in some examples, the at least one radiation-treated region may have a third appearance under exposure to IR light and the at least one non-radiation-treated region may have a fourth, different appearance under exposure to IR light.

In some examples, the technique of FIG. 5 may optionally include exposing at least one third region (a second radiation-treated region) to infrared light to change at least one property of the reduced tungsten oxide in the at least one third region and cause the at least one third region exhibits a third, different appearance under exposure to visible light. The third, different appearance may be different from the first appearance and different from the second, different appearance. For example, the third, different appearance may be darker than both the first appearance and the second, different appearance, and may be caused by using a high energy infrared light that causes charring of the polymer within the at least one third region.

EXAMPLES

Comparative Example 1 and Examples 1-5

Multiple samples of a prismatic retroreflective sheeting were prepared from the following components:

TABLE 1

| | CsWO in final composition (Wt. %) | CsWO-HDDA (grams) | Cube resin (grams) | TPO additional |
|---|---|---|---|---|
| Comparative Example | | | 800 | 18.63 |
| Example 1 | 0.125 | 1.245 | 204.65 | |
| Example 2 | .025 | 2.49 | 204.65 | |
| Example 3 | 0.5 | 4.99 | 204.65 | |
| Example 4 | 1.0 | 9.98 | 204.65 | |
| Example 5 | 3.0 | 29.94 | 204.65 | |

CsWO-HDDA was obtained by solvent exchange of a CsWO nanoparticle dispersion (obtained from Sumitomo Metal and Mining Co., Ltd., Tokyo, Japan) in to 1,6-hexanediodiacrylate (HDDA) obtained from Sartomer Americas, Exton, Pa. Cube resin was a mixture including about 50 wt. % trimethylolpropane triacrylate (TMPTA), about 25 wt. % HDDA, about 25 wt. % bisphenol-A-diacrylate, about 0.5 wt. % 2,4,6-trimethylbenzoyl-diphenyl-phosphineoxide (TPO), and about 0.5 wt. % 2-Hydroxy-2-methyl-1-phenyl-propan-1-one (available from Ciba Specialty Chemicals Inc., Basel, Switzerland, under the trade designation Ciba® DAROCUR® 1173). For the Comparative Example, additional TPO was added to the cube resin. The CsWO-HDDA and the cube resin were mixed in the proportions set forth in Table 1 and microreplicated to make a structured layer, as described in U.S. Patent Application Publication No. 2013/0034682, the entire disclosure of which is incorporated by reference herein.

The structured layer made as described above was laminated to a white, $TiO_2$-containing adhesive with barrier layers to form microreplicated prismatic sheetings, as described in U.S. Patent Application Publication No. 2013/0034682. The microreplicated prismatic sheetings were exposed to a Keyence Laser Marking instrument (MD-V9900 Series, available from Keyence Corporation, Osaka Japan). The Keyence Laser Marking instrument is a Neodymium-Yttrium Vanadate laser ($Nd:YVO_4$) equipped with software that allows varying of the scanning speed, power output, and the frequency of the instrument to adjust the energy delivered to the exposed material. The maximum output of the laser is approximately 8 watts. The distance between the sample and the focusing lens of the laser can also be adjusted for better focus.

Figure 6:
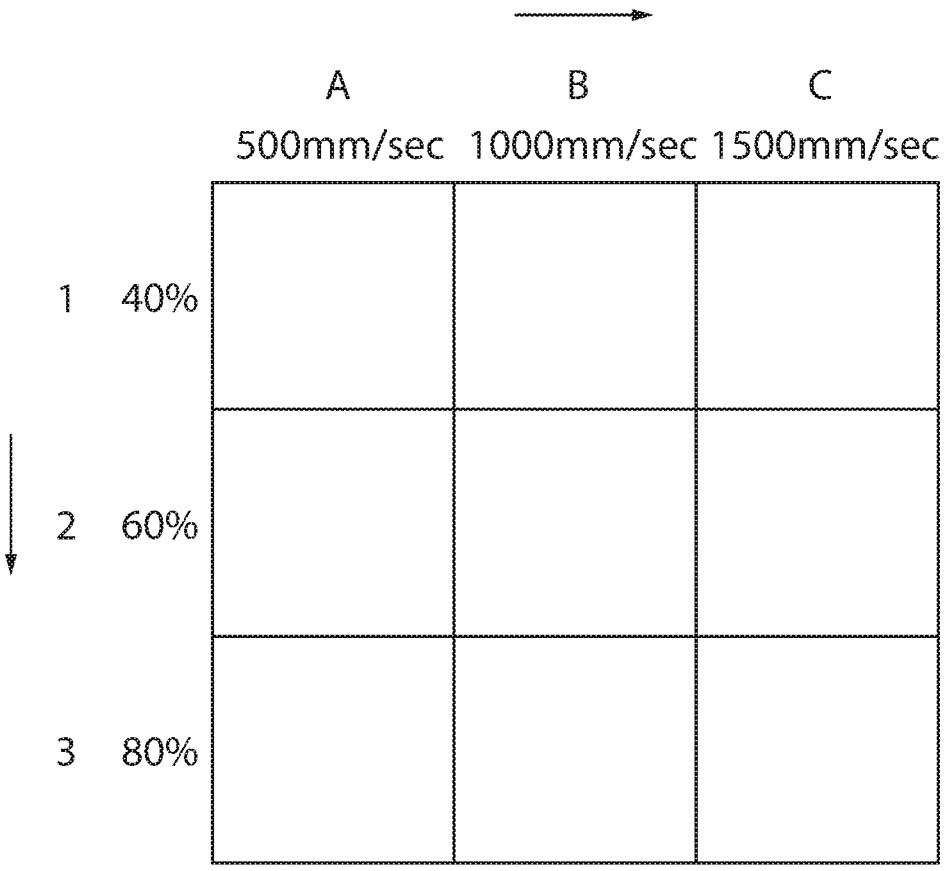
FIG. 6 is a conceptual diagram illustrating the various combinations of power level and scanning speeds used to expose portions of a security document to coherent electromagnetic radiation.

Sheets made from the formulations shown in Table 1 were exposed to the laser at different power levels and 20 Hz frequency. The laser had a 1064 nm wavelength. The power level was varied from 40% to 80% while the scanning speed was varied from 500 mm/sec to 1500 mm/sec. FIG. 6 is a conceptual diagram illustrating the various combinations of power level and scanning speeds for the respective squares shown below in FIGS. 7 and 8.

Figure 7:
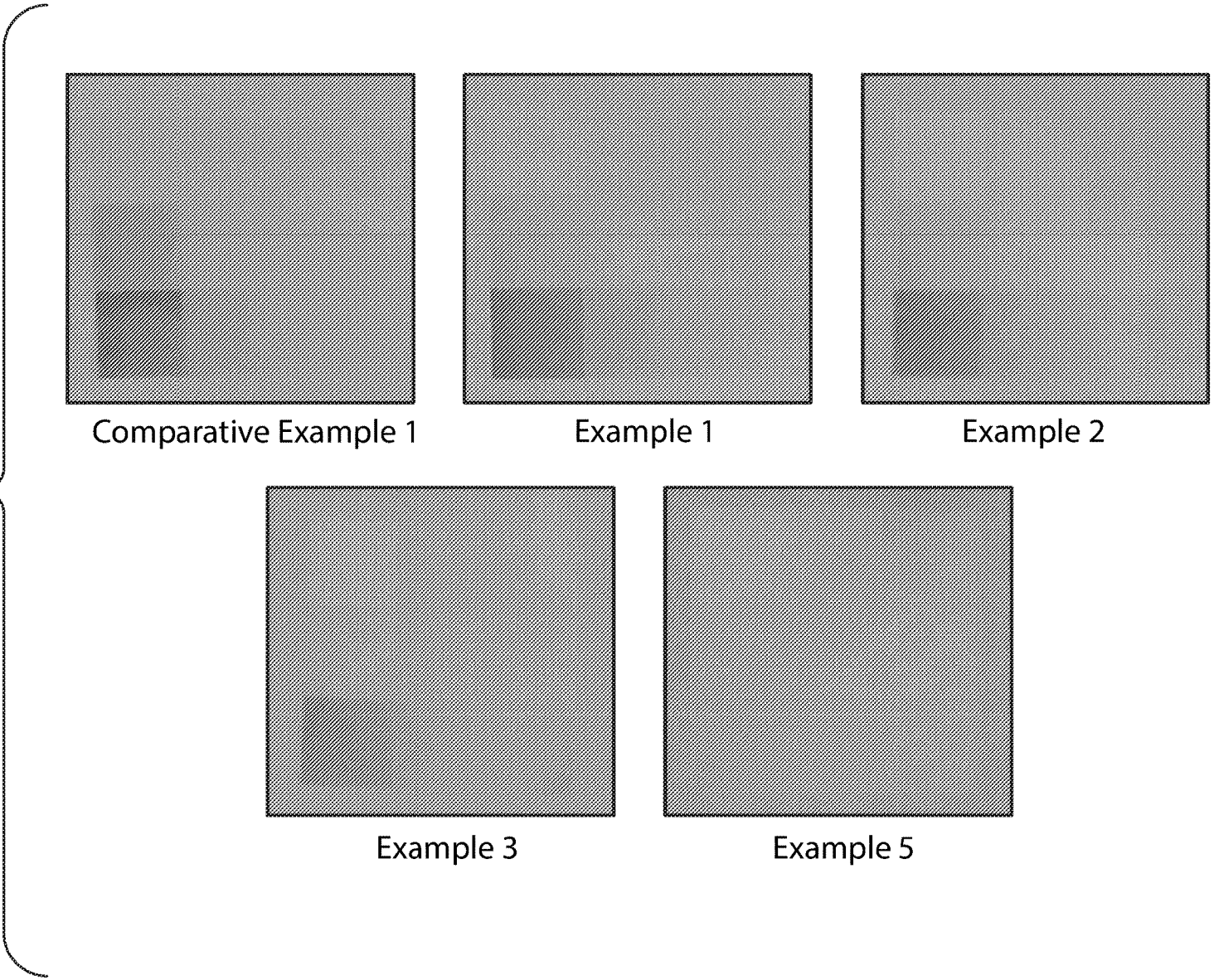
FIG. 7 is a set of photographs illustrating visible light images of a security document including microreplicated prismatic sheeting that includes an infrared absorptive material including cesium tungsten oxide after exposure to laser energy.

Visible images were recorded using a SAMSUNG Galaxy SIII® cell phone camera (available from SAMSUNG Electronics, Seoul, South Korea). The images were obtained in office lighting conditions. No further image processing was carried out. FIG. 7 is a set of photographs illustrating visible light images of microreplicated prismatic sheeting made from the compositions of Comparative Example 1 and Examples 1-3 and 5, after exposure of portions of the microreplicated prismatic sheeting to the laser power described above and illustrated in FIG. 6.

The microreplicated prismatic sheeting formed from the composition of Comparative Example 1 shows minimal effect at most laser conditions and a darkening effect after the laser treatment with low speed and high and intermediate laser power, while samples containing CsWO (labeled Examples 1-3 and 5 with increasing CsWO content) show a lightening (or decolorization) effect in the laser treated regions. The lightening effect is more pronounced as the CsWO content increases, as the bluish tint of the untreated regions increased as the CsWO content increased.

Figure 8:
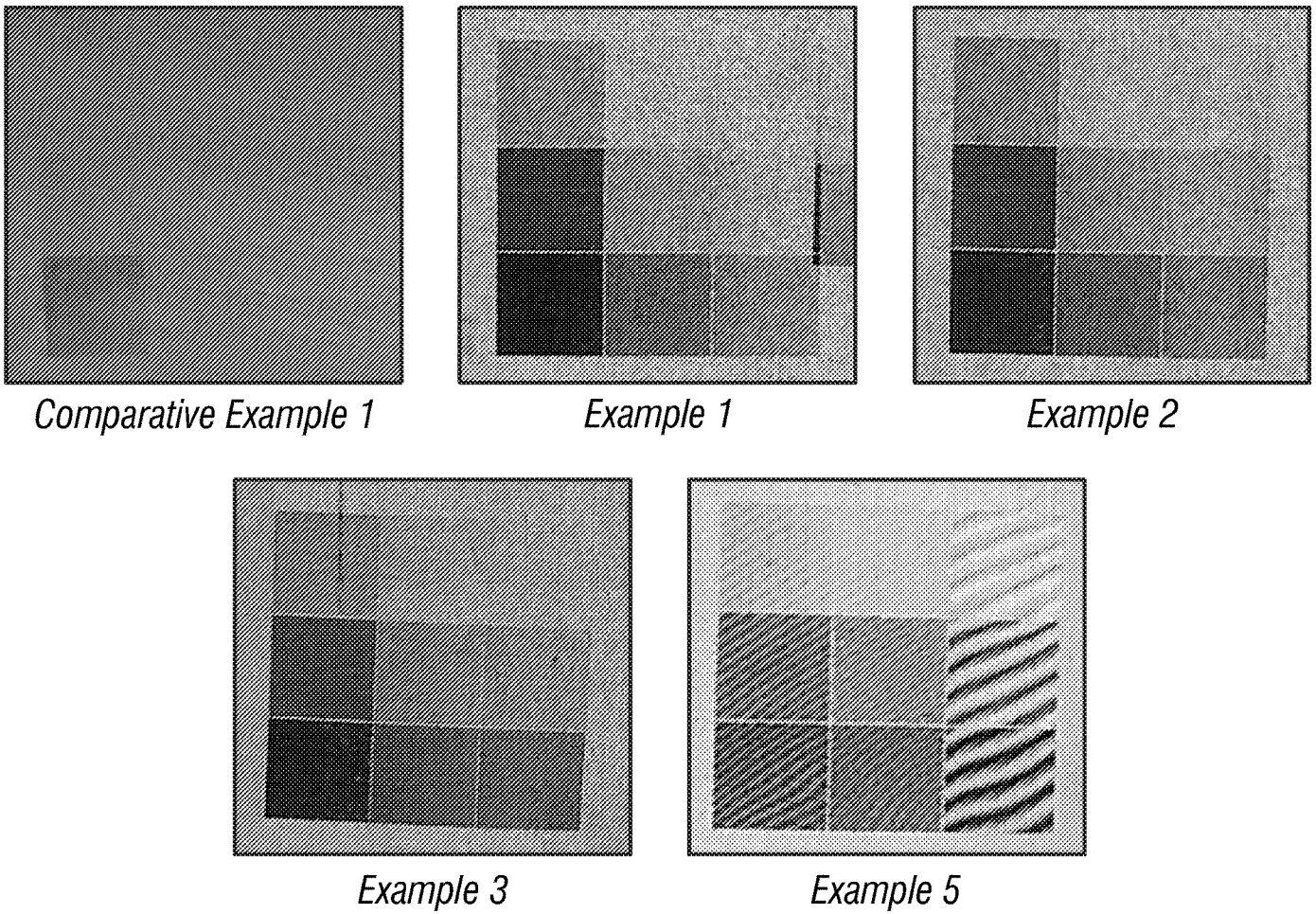
FIG. 8 is a set of photographs illustrating visible light images under retroreflection of a security document including microreplicated prismatic sheeting that includes an infrared absorptive material including cesium tungsten oxide after exposure to the laser energy.

Visible images in retroreflection were recorded using a SAMSUNG Galaxy SIII® cell phone camera (available from SAMSUNG Electronics, Seoul, South Korea) by taking the images in a dark room with only cellphone flash as the light source. No further image processing was carried out. FIG. 8 is a set of photographs illustrating visible light images in retroreflection of microreplicated prismatic sheeting made from the compositions of Comparative Example 1 and Examples 1-3 and 5, after exposure of portions of the microreplicated prismatic sheeting to the laser energy described above.

Visible images in retroreflection of the microreplicated prismatic sheeting formed from the composition of Comparative Example 1 (containing no CsWO) appears colorless or white before laser treatment but shows a slight darkening effect post laser treatment at low speed and high power (thereby indicating decrease in retroreflectivity). Visible images in retroreflection of the microreplicated prismatic sheeting formed from the composition of Comparative Example 1 (containing no CsWO) show little difference when treated at medium and high speeds and low and medium power. On the other hand, the images of the treated portions of the microreplicated prismatic sheeting formed from the composition of Examples 1-3 and 5 appear darker (as a result of loss of retroreflectivity as a result of the laser exposure) The darkening effect in retroreflectivity is more pronounced with increasing CsWO content, decreasing speed, and increasing power.

Example 6

This example demonstrates incorporating CsWO in water-based polymer systems. The CsWO dispersion in HDDA does not mix well with water-based polymers. But when mixed with another monomer system that is compatible with water-based polymers, the CsWO-HDDA can form a stable mixture. A water dispersible CsWO-HDDA combination was made by mixing it in a monomer system shown in Table 2.

TABLE 2

| Component | Amount (grams) |
|---|---|
| SR504 | 22 |
| SR348 | 5 |
| CsWO-HDDA | 5 |

SR504 is an ethoxylated (4) nonyl phenol acrylate available from Sartomer Americas, Exton, Pa. SR348 is an ethoxylated (2) bisphenol A dimethacrylate available from Sartomer Americas, Exton, Pa.

Examples 7 and 8

A mixture of the composition of Example 6 and water-based polyurethane dispersions was prepared according to Table 3.

TABLE 3

| | Example 7 (Weight (g)) | Example 8 (Weight (g)) |
|---|---|---|
| NeoRez ® R-9621 | 30 | 0 |
| Neorez 9605 | 0 | 30 |
| Example 6 | 4 | 10 |

NeoRez® R-9621 is an aliphatic polyester waterborne urethane dispersion available from DSM NeoResins B.V., Wallwijk, Netherlands, which becomes a hot melt adhesive when dry. NeoRez® R-9603 is an aliphatic waterborne urethane dispersion available from DSM NeoResins B.V., Wallwijk, Netherlands, which turns to a hard film when dry.

Comparative Example 2

The adhesive sides of two 12-mil thick films made from 5 mil thick ethylene-vinyl acetate (EVA) hot-melt adhesive coated on 7-mil thick polyethylene terephthalate (PET) were brought together and laminated with a heat laminator at 320° F. The lamination of this construction creates a card-like rigid structure. The laminate was cut to a card size and a white label attached to it on one side since the laser marking machine does not allow a transparent card go through for marking. The card was then placed in the hopper of a DATACARD® MX6000 ™ card issuance system (available from Datacard Group, Minnetonka, Minn.) that has laser marking capability to determine whether the cards can be marked. The marking occurred at a frequency of 50 Hz and 600 DPI. The cards were marked with personalization photograph created on the card. The marked images looked grey and alphanumeric content had a silver looking appearance that was faded in some locations.

Example 9

A composition of Example 7 was coated with #6 Mayer bar onto the adhesive side of a 12-mil thick film that was made from 5-mil thick EVA hot-melt adhesive coated on 7-mil thick PET. Another piece of the same 12-mil film was brought and the adhesive side of the second film and film coated with the composition of Example 7 were held face-to-face with the adhesives touching and laminated with a heat laminator at 320° F. The card-like laminate was cut to a card size and a white label attached to one side since the laser marking machine does not allow a transparent card go through for laser marking. The cards were then placed in the hopper of the MX6000™ card issuance system. The laser marking took place at a frequency of 50 Hz and 600 DPI. The cards were marked. Compared to comparative example 3, the marking is a darker and more visible personalized photograph.

Example 10

A composition of Example 8 was coated using notch bar coater on to a sheet of 5-mil thick PET film and dried at 50° C. in an oven for 5 minutes. The coating dried to a thickness of about 3 mil. This was laminated to the EVA side of an uncoated 12-mil thick film that was made from 5-mil thick EVA hot-melt adhesive coated on 7-mil thick PET. The whole laminate was cut to a card size and a white label is attached to it on the opposite side of the coating since the laser marking machine does not allow a transparent card go through for laser marking. The card prepared this way was placed in the hopper of the MX6000™ card issuance system. A similar card construction was prepared but without including the composition of Example 6 in the composition of Example 8 to determine if there is a difference in laser marking. The result is that the construction that includes the composition of Example 6 engraved more vivid picture and alphanumeric content than the one that does not include the composition of Example 6.

Comparative Examples 3 and 4 and Examples 11-15

Reflectance and color measurements were made using a HunterLab UltraScan PRO spectrophotometer (available from Hunter Associates Laboratory, Inc., Reston, Va.), which meets CIE, ASTM and USP guidelines for accurate color measurement. The UltraScan PRO uses three Xenon flash lamps mounted in a reflective lamp housing as light source. The spectrophotometer is fitted with an integrating sphere accessory. This sphere is 152 mm (6 inches) in diameter and complies with ASTM methods E903, D1003, E308, et. al. as published in "ASTM Standards on Color and Appearance Measurements", Third Edition, ASTM, 1991. All samples were analyzed for percent reflectance with a white plate behind the sample. All samples were measured on the spray coated side with the adhesive backing facing the white plate. The spectra were measured in the range of 350 nm to 1050 nm with 5 nm optical resolution and reporting intervals. The spectra were recorded first with specular reflection included and then with specular reflection excluded. The color measurements were taken under D65/10 illumination.

Figure 9:
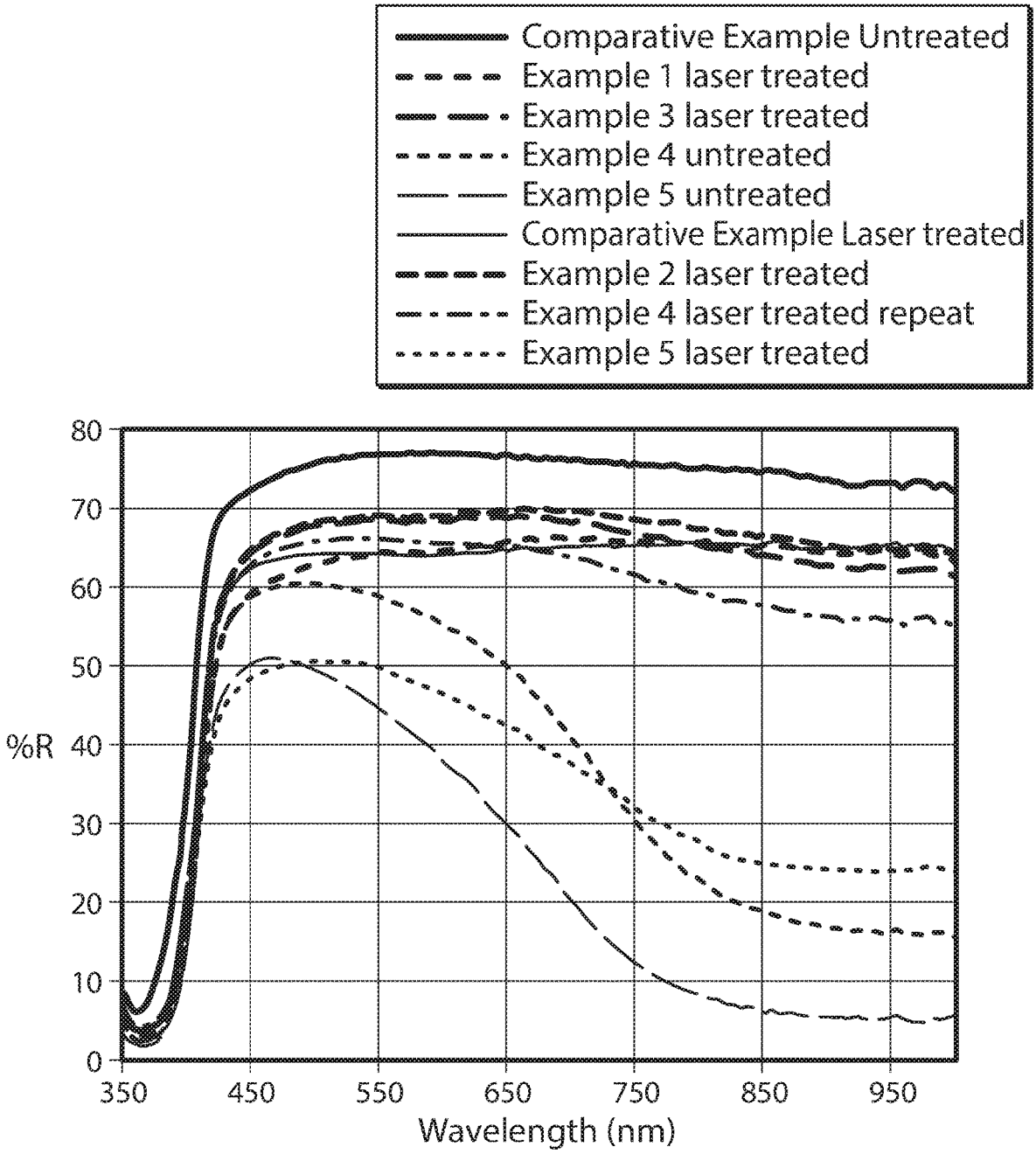
FIG. 9 is a diagram illustrating percent reflection versus wavelength for a security document including prismatic retroreflective sheeting.

FIG. 9 is a diagram illustrating percent reflection versus wavelength for prismatic retroreflective sheeting samples made from the compositions of Examples 1-5 (shown below in Table 1), along with samples formed from Comparative Example 1 (Table 1).

The sample made from the composition of Example 4 showed a strong IR absorption prior to laser treatment, but showed a much decreased (or faint) IR absorption after laser treatment. Similarly, the sample made from the composition of Example 5 showed reduced IR absorption after laser treatment. Similarly, the laser-treated samples made from the compositions of Examples 1-5 show faint IR absorption after laser treatment. Conversely, the samples formed from Comparative Example 1 show increased IR absorption after laser treatment.

In addition, as shown in Table 4 below, color measurements also indicate an increase in L* from 80.71 for untreated sample made from the composition of Example 4 to L* of 84.8 for laser treated sample made from the composition of Example 4.

TABLE 4

| ID | L* | a* | b* |
|---|---|---|---|
| Comparative Example untreated | 89.07 | −1.64 | 4.33 |
| Comparative Example laser treated | 88.1 | −1.61 | 4.28 |
| Example 1, 0.125% CWO untreated | 87.32 | −2.06 | 5.07 |
| Example 1, 0.125% CWO laser treated | 87.82 | −1.67 | 5.51 |
| Example 2, 0.25% CsWO untreated | 86.6 | −2.59 | 4.34 |
| Example 2, 0.25% CsWO laser treated | 87.18 | −1.77 | 5.42 |
| Example 3, 0.5% CsWO untreated | 84.61 | −3.24 | 3.06 |
| Example 3, 0.5% CsWO laser treated | 85.85 | −1.92 | 4.94 |
| Example 4, 1% CsWO untreated | 80.71 | −5.07 | 0.71 |
| Example 4, 1% CsWO laser treated | 84.87 | −2.24 | 3.99 |
| Example 5, 3% CsWO untreated | 72.03 | −8.65 | −5.3 |
| Example 5, 3% CsWO laser treated | 75.26 | −5.11 | 1.73 |

Comparative Example 5 and Examples 16-19

Retroreflective brightness measurements were performed on prismatic retroreflective films prepared as described with respect to Comparative Example 1 (Comparative Example 5) and Examples 1-3 and 5 (Examples 16-19). Retroreflectivity (RA) of the samples was measured at observation angle of 0.2, entrance angle of −4 degrees, and orientation of 0 degrees using a 932 Handheld Retroreflectometer from RoadVista (San Diego, Calif.). All units are candela per incident lux per square meter (cd/lx/m$^2$). Table 5 shows the results of these measurements, taken at an untreated region, at region A1 (FIG. 6) and B2 (FIG. 6) for each sample. As seen in Table 5, the Comparative Example shows essentially no change in retroflectivity after laser treatment, while Examples 16-19 exhibit a drop in retroreflectivity.

TABLE 5

| ID | Untreated | A1 | B2 |
|---|---|---|---|
| Comparative Example 5 | 209 | 212 | 214 |
| Example 16 | 89 | 54 | 60 |
| Example 17 | 104 | 55 | 64 |
| Example 18 | 127 | 83 | 75 |
| Example 19 | 73 | 59 | 40 |

Various examples have been described. These and other examples are within the scope of the following claims.

The invention claimed is:

1. An article comprising an image, wherein the image comprises:

at least one layer comprising a polymer and an infrared absorptive material, wherein the at least one layer comprises:

at least one infrared radiation-treated region that exhibits a first appearance under exposure to visible light;

at least one non-radiation-treated region that exhibits a second, different appearance under exposure to visible light, wherein the article is a retroreflective sheeting, wherein the L* value of the infrared radiation-treated region is higher compared to the corresponding L* value of the same region before radiation treatment, and wherein the retroreflectivity of the infrared radiation-treated region is lower compared to the corresponding retroreflectivity of the same region before radiation treatment.

2. The article of claim 1, wherein the infrared absorptive material includes a reduced tungsten oxide.

3. The article of claim 2, wherein the reduced tungsten oxide is selected from the group consisting of cesium tungsten oxide, sodium tungsten oxide and potassium tungsten oxide.

4. The article of claim 1, wherein the at least one radiation-treated region is formed by exposing the at least one radiation-treated region to coherent infrared light.

5. The article of claim 1, wherein the at least one radiation-treated region exhibits a third appearance under exposure to infrared light, wherein the at least one non-radiation-treated region exhibits a fourth, different appearance under exposure to IR light, and wherein the third appearance is lighter than the fourth, different appearance.

6. The article of claim 1, wherein the at least one radiation-treated region and the at least one non-radiation-treated region comprise more than 0 wt. % and less than about 5 wt. % of the infrared absorptive material.

7. The article of claim 1, wherein the at least one layer comprises a at least one of beads, lenslets, prisms, or cube corner elements.

8. The article of claim 1, wherein the polymer is radiation-curable.

9. The article of claim 1, wherein the polymer comprises an adhesive.

10. The article of claim 1, wherein the at least one radiation-treated region comprises a first radiation-treated region, wherein the at least one layer further comprises at least one second radiation-treated region that exhibits a third, different appearance under exposure to visible light, and wherein the third appearance is formed by exposing the at least one second radiation-treated region to infrared light to change at least one property of the reduced tungsten oxide in the at least one second radiation-treated region compared to the at least one property of the reduced tungsten oxide in the at least one non-radiation-treated region and the at least one property of the reduced tungsten oxide in the at least one radiation-treated region.

11. The article of claim 1, wherein the first appearance is lighter than the second appearance.

12. The article of claim 1, further comprising an information-containing layer on the at least one layer comprising the polymer and the infrared absorptive material, wherein the information containing layer comprises at least one indicia defining an edge, and wherein the at least one radiation-treated region is positioned within the at least one layer such that the at least one radiation-treated region is adjacent at least part of the edge of the indicia.

13. The article of claim 1, wherein the article is selected from the group consisting of a passport, an identification document, a bank note, a license plate, a traffic signage, a validation sticker and a personal protective equipment.

* * * * *